United States Patent [19]

Kedian, Jr.

[11] 4,124,788

[45] Nov. 7, 1978

[54] MULTI-TERMINAL CONNECTOR ELEMENT

[76] Inventor: Harold F. Kedian, Jr., 267 N. Gate Rd., Manchester, N.H. 03104

[21] Appl. No.: 782,003

[22] Filed: Mar. 28, 1977

[51] Int. Cl.[2] ..... H01R 13/70

[52] U.S. Cl. ..... 200/51 R; 200/110 A; 200/14; 200/307

[58] Field of Search ..... 200/51 R, 307, 292, 200/241, 5 R, 1 R, 11 R, 110, 110 A, 14

[56] References Cited

U.S. PATENT DOCUMENTS

| | | | |
|---|---|---|---|
| 2,613,287 | 10/1952 | Geiger | 200/1 R |
| 3,120,584 | 2/1964 | Grunfelder et al. | 200/292 X |
| 3,190,975 | 6/1965 | King, Jr. | 200/5 R |
| 3,886,335 | 5/1975 | Hendricks | 200/1 R |

FOREIGN PATENT DOCUMENTS

| | | | |
|---|---|---|---|
| 810,072 | 3/1959 | United Kingdom | 200/292 |

*Primary Examiner*—Stephen P. Garbe

*Attorney, Agent, or Firm*—Sewall P. Bronstein; Robert Gammons; Donald Brown

[57] ABSTRACT

A multi-terminal connector element comprising a stack of alternately arranged conductor grids and spacer grids containing spaced parallel lines of spaced openings which collectively define spaced parallel passages, the axes of which are perpendicular to the planes of the grids, spaced parallel conductors on the opposite faces of the conductor grids continuously extending from edge to edge along the openings with portions extending into the openings, said conductor grids being arranged so that the conductors in adjacent conductor grids are at right angles to each other, wiper bearing elements adapted to be inserted into the passages, mounting wipers which extend radially therefrom and axially spaced therealong a distance corresponding to the distance between conductor grids, said wiper carrying elements being rotatable to move the wipers into engagement with the inwardly extending portions of the conductor elements and conductor elements within the wiper bearing elements connecting the wipers.

23 Claims, 14 Drawing Figures

MULTI-TERMINAL CONNECTOR ELEMENT

BACKGROUND OF INVENTION

The current system employed in telephone circuitry, employing the "old type" main distributing frame, entails multitudinous cross-wiring and splicing, requires the use of large and heavy structures which take up an enormous amount of building space, and because of the complexity of the wiring and the density resulting from the packing of thousands of pairs of wires on the horizontal shelves of said frame, makes the tracing, addition to, and replacement of cross-wiring extremely difficult, very expensive and time-consuming.

The "new" No. 1 ESS frame and its later so-called "cosmic" frame replacement actually create more problems than they solve, i.e.; (A) while the size and weight of the "old" frame is circumvented to some extent, the complete flexibility of the "old" frame is totally lost since, perphaps 95 percent of the wires to be connected are segregated into 6000 connection modules with very small cross-wiring gutters provided at the top and bottom of each module for use in connecting module-to-module. Because these "gutters" are so small, the amount of module-to-module cross-wiring is extremely limited. For these reasons, the complete ultimate number of modules have to be installed initially. Because this design is so poor, the ultimate building also has to be built initially to house the modules. This design, therefore, requires wire counts of each cable entering the building to be spread across all the modules. All of these horrendously costly procedures arise from the fact that there is substantially no cross-wiring flexibility in the system design. Finally, the ESS frame cannot handle multi-wire circuits such as video, carrier, and long-distance wire circuitry, ergo, a separate "old type" frame is a must to meet these needs.

The multi-terminal connector structure of this invention is designed to eliminate the lost time, high cost of operation and maintenance inherent in the prior systems, in particular, in the field of telephone circuitry, it being understood, however, that it has wider application than this, for example, in the computer and power fields.

SUMMARY OF INVENTION

As herein illustrated, the invention resides in a structure comprised of a nonconductive material containing a plurality of spaced parallel passages and in planes at right angles to the axes of the passages, spaced parallel arrays of spaced parallel conductor elements, portions of which extend into the passages, and portions of which extend from the ends of the structure to which conductor wires may be attached, wiper carrying elements adapted to be inserted into the passages to which are mounted wipers in axially spaced relation thereon for engagement with the inwardly projecting portions of the conductors by rotation within the passages, and conductor means within the wiper carrying elements for connecting the axially spaced wiper elements. More specifically, the structure comprises a stack of alternate conductor grids and spacer grids containing spaced parallel lines of spaced parallel openings which collectively define spaced parallel passages, the axes of which are perpendicular to the planes of the grids, and spaced parallel conductors on the opposite faces of the conductor grids extending continuously from edge to edge along the openings with parts extending into the openings, said conductor grids being arranged so that the conductors in adjacent conductor grids are at right angles to each other. The wiper carrying elements are sleeves of nonconductive material containing longitudinally thereof wall slots for receiving the wiper elements, each of which is provided with a portion dimensioned to be received within the inside of the sleeve, a portion to extend through the wall slots therein and a blade for engagement with the inwardly projecting portion of the conductor within the passage. The wiper elements are spaced within the sleeve by means of conductive slugs of predetermined length inserted into the sleeve and are locked therein by a threaded plug at one end of the sleeve screwed thereinto and a threaded nub screwed into the other end of the sleeve which serves as a head which may be grasped to rotate the carrier within the passage.

The invention will now be described with reference to the accompanying drawings wherein.

Figure 2:
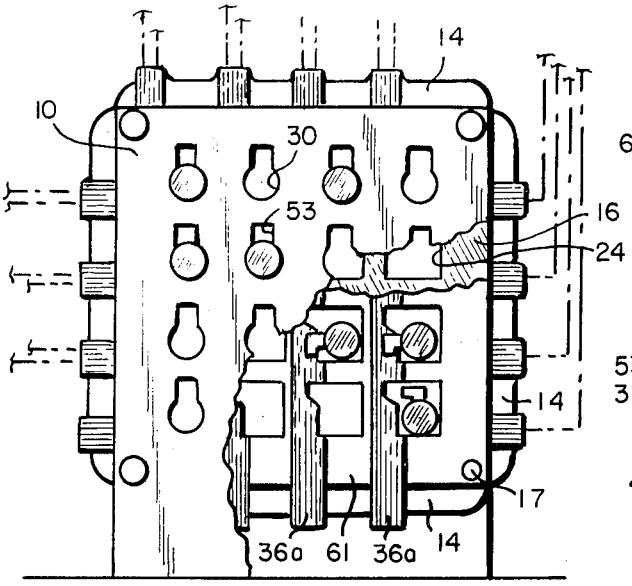
FIG. 2 is a front view as seen from the left side of FIG. 1.
Figure 1:
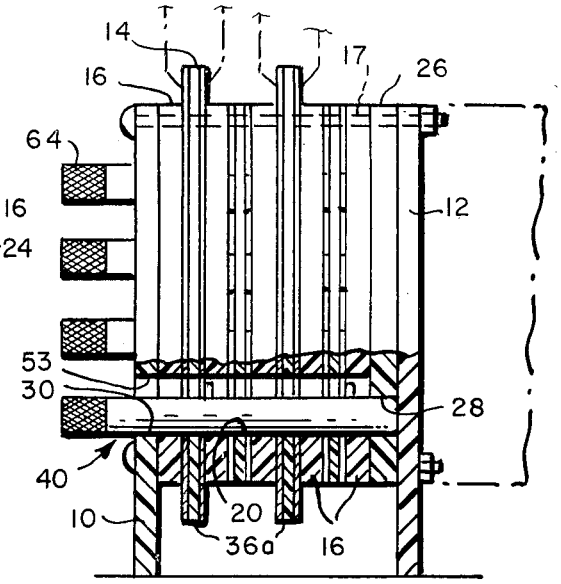
FIG. 1 is a side view of the structure.

Referring to the drawings, FIGS. 1 and 2, there are spaced parallel front and back grid plates 10 and 12 between which there is secured a stack of grid plates comprising alternately arranged conductor plates 14 and spacer plates 16. The two end plates 10 and 12 are vertically longer than the intermediate plates 14 and 16 and the latter are bolted between the front and back plates by means of dielectric (insulated material) bolts 17 engaged within holes 18 at the four corners of the plates with their upper edges flush with the upper edges of the front and back plates so that their lower edges are spaced from the lower edges of the front and back plates and so that the extending portions only of the front and back plates constitute supporting legs for the structure, together with a grounded metallic overall supporting framework.

All of the plates are comprised of a nonconductive material and contain openings arranged in spaced parallel lines horizontally and vertically of the planes and in registration from plate to plate such as to collectively define spaced parallel passages 20 extending horizontally through the structure from front to back for selectively receiving wiper bearing elements 40.

Figure 3:
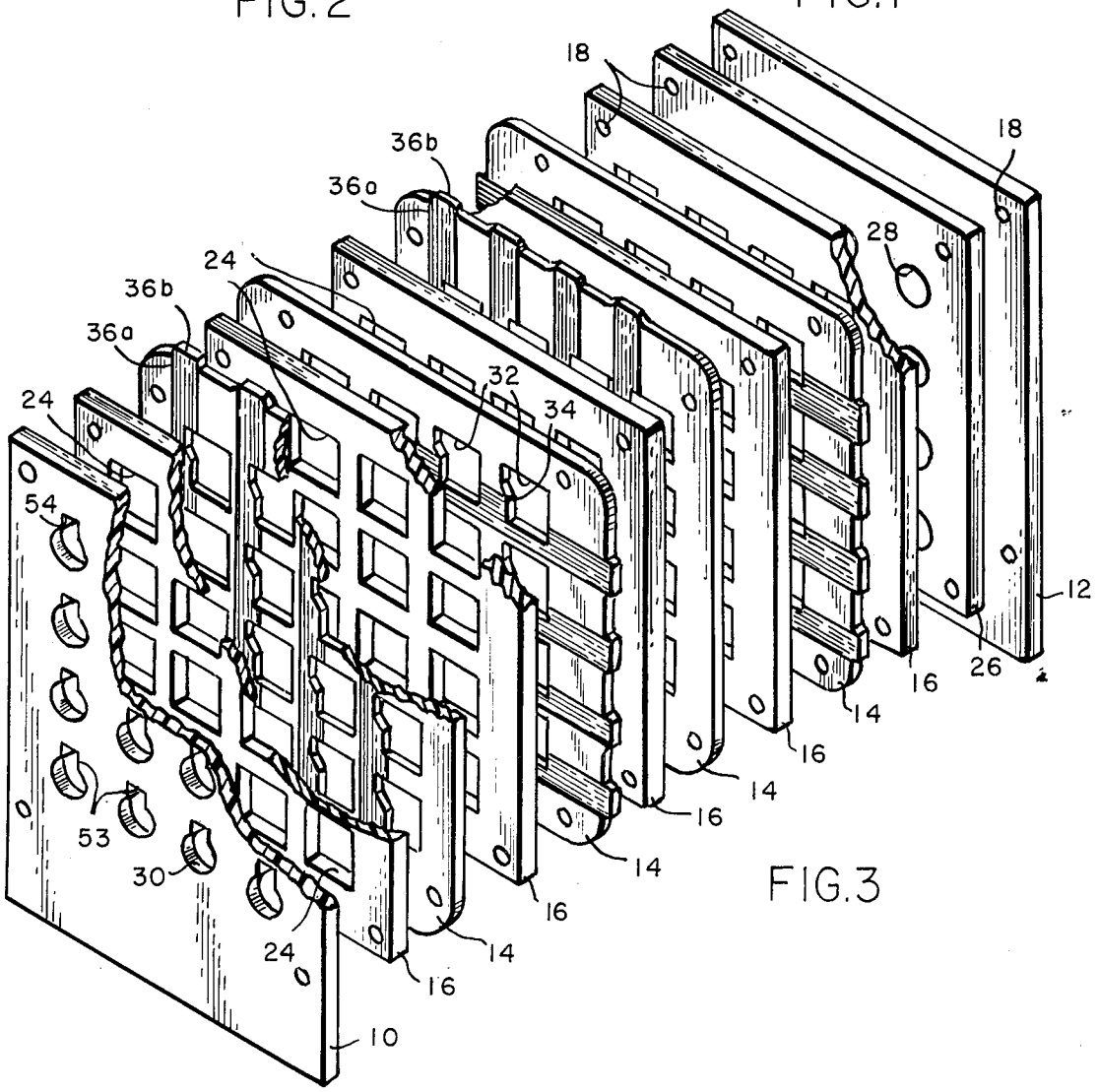
FIG. 3 is an exploded isometric of the component parts of the structure shown in FIGS. 1 and 2.
Figure 4:
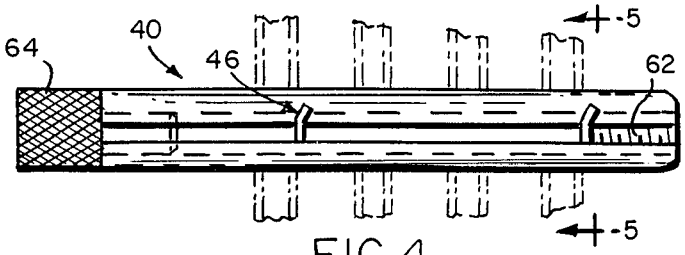
FIG. 4 is a plan view of a wiper carrier element showing the relation of the wiper elements to the conductor components.

The spacer plates 16, FIG. 3, contain rectangular openings 24 of greater cross section than the cross section of the wiper carrier elements. Adjacent the back plate 12, there is a bearing plate 26 containing bearing openings 28 for rotatably receiving the ends of wiper carrier elements inserted into the passages and the front plate 10 contains openings 30 of corresponding diameter for rotatably receiving the forward ends of the wiper carrier elements. The bearings 28 and 30 support the wiper carrier elements for rotation about axes parallel to the axes of the passages 20.

The conductor plates 14 contain openings 32 arranged in spaced parallel rows as they are in the spacer plates so as to be in axial registration and along the left-hand vertical side of each of the holes 32 there is an inwardly projecting shoulder 34, the shoulders 34 thus projecting into the passages 20 and being axially aligned.

Each conductor plate 14 has on its opposite surfaces spaced parallel conductors **36*a* on one side and 36*b* on the other side which extend continuously from edge to edge of the plate. The conductors 36*a*, 36*b* are situated along the rows of the openings 32 therein at the sides of the openings from which project the shoulders 34** so that portions of the conductors corresponding in configuration to the shoulders extend into the openings.

Figure 5:
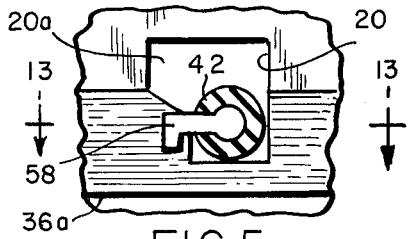
FIG. 5 is a section taken on the line 5—5 of FIG. 4.
Figure 6:
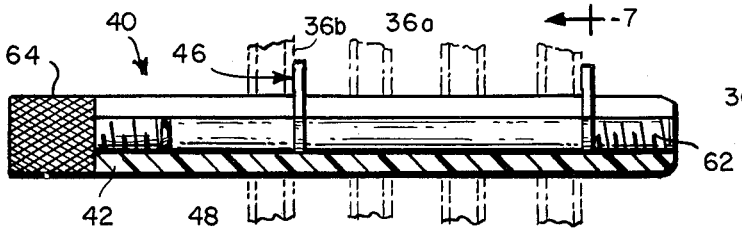
FIG. 6 is an elevation partly in section of the wiper carrier element shown in FIG. 4 in relation to the conductor components.
Figure 7:
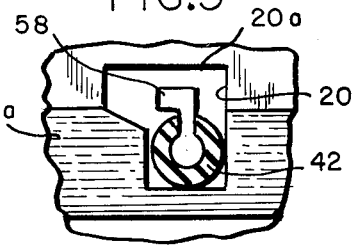
FIG. 7 is an elevation partly in section taken on the line 7—7 of FIG. 6.
Figure 8:
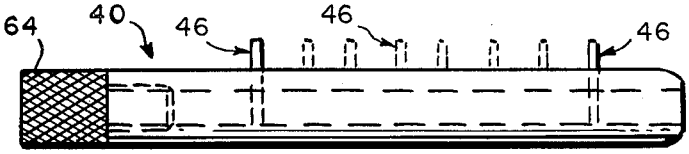
FIG. 8 is an elevation of the wiper bearing element removed from the structure showing the disposition of a plurality of wiper elements therealong.
Figure 12:
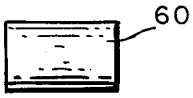
FIG. 12 is a plan view of a conductor slug.
Figure 9:
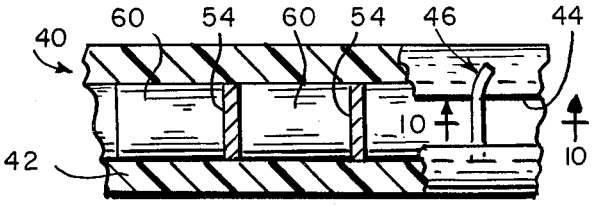
FIG. 9 is an enlarged fragmentary plan of the wiper bearing element showing the conductor slugs therein.
Figure 10:
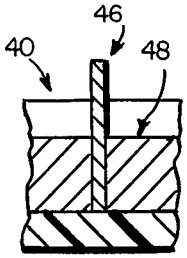
FIG. 10 is a section taken on the line 10—10 of FIG. 9.

The conductor plates 14 are arranged so that the conductors **36*a*, 36*b* on adjacent conductor plates are at right angles to each other as shown in FIGS. 2 and 3. As shown in FIGS. 5 and 7, the wiper carrying elements are supported by the bearings 28, 30 with their axes situated in the passages within the portion defined by the inwardly projecting shoulder 34** and the sides of the openings opposite the shoulders.

The opposite ends of the conductor elements **36*a*, 36*b* project from the stack of grids as shown in FIG. 2** so that conductor wires which are to be connected can be soldered thereto in pairs and preferably in an identifiable combination of colors.

The connections are made within the structure by wiper carrying elements 40 shown in FIGS. 4 to 14 inclusive, each wiper carrying element comprising a rigid nonconductive sleeve 42 of a circular cross section which is less than the cross section of the passages 20 so that it can be pushed through the open end of the passage and through the passage into engagement with the rear plate 12. The rear plate 12 thus constitutes a positioning means for limiting the plugging of the wiper carrier into the passage. The sleeve 42 contains a longitudinally extending wall slot 44 for the mounting of wiper elements 46 in radially extending relation to the axis of the sleeve with their inner ends in conductive engagement with a conductor material 48 in the sleeve.

The bearing openings 28 and 30 rotatably support the wiper carriers within the passages with a clearance space **22*a* along one side so that the wiper carriers from which the wipers extend radially can be inserted axially into the passages and then rotated to move the wipers into engagement with the shoulers 34, FIGS. 5 and 7. The bearing openings 30 in the front plate are provided with slots 53 to permit the wiper elements to be introduced into the passages 20**.

Figure 11:
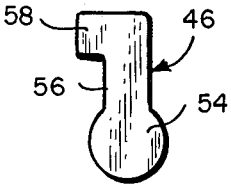
FIG. 11 is a plan view of a wiper element.
Figure 13:
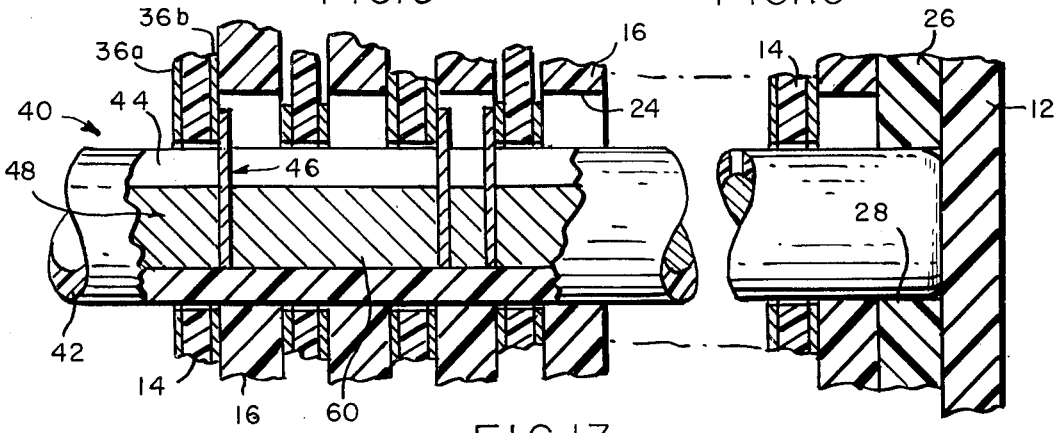
FIG. 13 is an enlarged fragmentary section taken on the line 13—13 of FIG. 5 showing the projection of the conductors into a wiper carrier passage and a wiper carrier plugged into the passage with the wipers engaged with the inwardly projecting portions of the conductors.

Each wiper elements as shown in FIG. 11 comprises a circular head 54 corresponding substantially to the inside diameter of the passage, a stem 56 corresponding to the width of the wall slot 44, and a blade 58 bent slightly out of the plane of the stem. The wiper elements are inserted through the open ends of the sleeve so that the stems 56 extend through the slot 44 and are retained therein by the conductor material 48 which is in the form of a plurality of metal slugs 60, FIG. 12, corresponding in diameter to the inside diameter of the sleeve inserted into the sleeve so that the ends of adjacent slugs engage the heads 54 of the wiper elements and thus hold them locked within the sleeve. A threaded nonconductive plug 62 is screwed into the inner end of the wiper carrier to close that end and after the conductor slugs and wiper elements have been installed within the sleeve, a nonconductive threaded cap 64 is screwed into the other end of the sleeve. The axial length of the conductor slugs 60 are selected so as to space the wiper elements at axial distances along the wiper carrier which corresponds to the distances between the conductors on the grid plates.

As thus constructed, a connection can be made between the conductors on the conductor grids within the structure by selecting a wiper carrier 40 which has elements mounted thereon at a spacing corresponding to the distance between the grid plates which are to be electrically joined, thrusting the wiper carrier through the slotted opening 30 in the front plate and through the passage until the rear end of the wiper carrying element is engaged within the bearing opening 28 in the bearing plate 26 and then rotating the wiper carrying element until the wipers engage the shoulders 34 of the conductors to be connected.

The wiper elements make contact with one horizontal conductor on one side of a particular conductor and with the same side of a particular vertical conductor, thus completing one side (plus or minus) of an electrical circuit. For example, current which enters the structure from the left side travels along the horizontal conductor until it reaches the horizontal wiper, thence along the conductor within the wiper carrier sleeve until it reaches the vertical wiper and thence along the vertical conductor and out of the structure. Assuming in this example that the connection made is the positive side of the circuit, to complete the circuit, another wiper carrier is inserted into the passage immediately to the right of the previously mounted wiper carrier to establish the negative side of the circuit, bearing in mind that the horizontal conductors extend continuously through the unit so that access to these conductors by way of the second wiper carrier can be made through any passages in the same horizontal plane. The wipers in this case, for example, from the negative side of the circuit are arranged on the wiper carrier in such a manner that they make contact with the opposite or negative side of the horizontal conductor being used so that current flows in the same plane as the positive along the sleeve in the adjacent passage and thence out of the structure.

The wires entering the horizontal conductors are soldered or wire-wrapped to the protruding ends and are differently colored and lightly twisted to form a pair and the wires leaving the vertical conductors are correspondingly colored and lightly twisted to establish a traceable completed circuit through the structure.

As described, two wiper carriers are used plugged into two passages along a single horizontal to complete the plus and minus sides of the circuit purely for reasons of simplicity, ease of manufacture and production costs. It is within the scope of this invention to employ a single wiper carrier plugged into a single passage by providing the wiper carrier with dual paths within the nonconducting sleeves.

Figure 14:
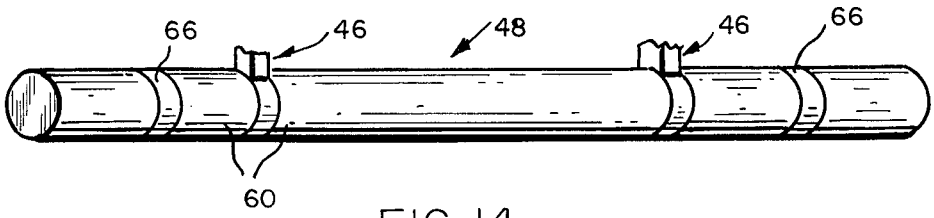
FIG. 14 is an elevation of the wiper carrier showing insulator slugs between the conductor slugs.

As illustrated in FIG. 14, insulator slugs 66 may be inserted between the conductor slugs 60 so that several connections can be made with a single wiper carrier independently of each other.

Both the conductor plates and spacer plates are comprised, for example, of a dielectric material such as an epoxy resin or carbon approximately ⅛ inch in thickness. The front and back plates and the rear bearing plate may be made of the same material. The grids as previously related are supported between the front and back plates by bolts and these are also comprised of a hard nonconductive epoxy resin or rigid carbon of sufficient shear and tensile strength to support the grid plates and to bind them together.

For the conductor plates, printed circuit boards may be employed with a copper coating on its opposite faces of approximately 1/16 inch. The copper-coated material is die-cut to provide the shoulder openings whereupon the copper coating between adjacent rows of openings is scraped or buffed off so as to provide uncoated areas 63 between the conductors **36*a* and 36*b*** which extend from edge-to-edge of the grid plates. The wiper elements are comprised of silver and the conductive slugs of aluminum.

The grid plates may be made in sizes of from 2 inches on a side up to 7 or 14 feet on a side or even more depending upon the number of circuits which have to be serviced and it is to be observed that the structure as herein described is particularly adapted to enable increasing or decreasing its capacity since all that is necessary is to add or remove grid plates from the unit by the simple expedient of removing the front plate and adding grid plates, or removing grid plates. The wiper carrying elements may be readily cut to the desired length for either increased capacity or reduced capacity. It is also possible by this arrangement to break a particular circuit and use the same passage and wiper carrier for making a circuit at a different location.

The structure as thus described makes it possible to handle multiple "taps," that is, connecting other wires to the existing, for example, two-wire circuit lugs on a horizontal or vertical for purposes such as toll testing. These are not, as currently done, tapped (soldered) to the same shoulders to which the two-wire circuit is connected, but to adjacent shoulders in the same horizontal or vertical which, of course, are electrically identical or common. The "tapping" is done by the wiper carrier and wipers in an adjacent passage. No wiring is required except outside the structure.

The ability to deal with such a problem in this way reduces labor by at least 80 percent. When it is considered that a large toll or long-distance frame embodies thousands of circuits, each of which must be tested regularly, the savings in building space, direct labor and energy (related to building size) are of great importance.

The same procedures may be followed if signaling wires from a long-distance machine need to be "half-tapped" to conductors within the structure of this application.

So far, two-wire connections have been discussed because most of the requirements are primarily local in character. However, four-wire circuitry is a constantly growing requirement since, at long distances, the voice or carrier signals are transmitted one way on two wires or equivalent and received in the reverse direction on the other two paths for transmission reasons. In addition, many of the switching machines are four-wire also, and for the same reasons. The larger four-wire machine is electromechanical in design; however, development of an electronic machine is expected in the near future. These future frames will be somewhat similar to the local two-wire machine in nature and will be some version of the "cosmic" frame previously mentioned with about the same characteristics.

Another problem arises in connection with toll test boards. The toll or long-distance distributing frames are at least as large as the local frames in most large offices and these toll frames are rapidly becoming larger and more complex and, for the latter reason, the testing of the circuits is extremely important.

Usually, the test boards are located in the direction of growth. This means that the test boards will have to be moved over and over again as growth takes places until such time as building addition is needed. The movement of test boards is fantastically costly, for instance, moving 10 toll test boards from one side of an aisle to another would amount to $300,000 to $500,000. A major share of this cost is spent in the complex wiring which has to be disconnected and then respliced, reterminated on the toll frame and then rewired position-by-position to the new location of the test board. Furthermore, this has to be done without interrupting the circuitry during the move.

Such relocation could be accomplished with the structure of this invention with no interruption at a cost of say $25,000 to $30,000 because of the possibility of making double and triple taps within the structure.

The "outside plant" of any telephone company presents the most fertile area for the use of the invention as herein described. Outside plant costs constitute 40 to 60 percent of the total annual construction and can amount to billions of dollars. Many suggestions have been made to alleviate this situation such as the "dedicated plant" notion. This scheme envisions permanently providing two pairs of wires from the central office to any individual existing or projected house, plus many other pairs in the case of an existing or proposed good-size business. It proved to be a failure after years of effort and much money spent. It has not worked because of poor design and engineering, poor administration and is basically unsound for such reasons as that it requires one type only switching machine.

The problem can be solved, however, assuming that a main feeder cable route is being reinforced for growth reasons by using the structure of this invention substantially as follows. Assuming there is not a duct problem is the office manhole, a cable of approximately the size required is run from the cable vault in the building through the office manhole and cut through a downtown duct system to the manhole through which the area needing relief will be reserved. Whereupon, a structure of suitable size is selected and the pairs of ingoing wires are connected to the vertical side and the matching outgoing pairs to the horizontal side. An incoming pair can be connected in a matter of a few minutes to any outgoing pair. Since the structure can be used in the outside plant and also on the office MD frame, the outside plant can now be economically balanced in the field on a traffic basis, together with the CO equipment balancing.

The structures are essentially made up elestrically in modules of 2×2×2 inch cubes and manufactured by extrapolating this configuration in certain ways to practically any size. The capacity of a structure may be easily calculated. For example, a structure 7×7×7 feet provided with wire pair inputs of four per square inch at all four sides provides a total of 56,448 connections. The front and back are used for wiper carrier passages so that the wiper carriers and wipers can enter the structure and make connections. By removing the conducting material in each horizontal in the middle and also in each of the vertical conductors, it is possible to double the inputs to the structure. A structure having a capacity of 56,448 connections will occupy 49 square feet and if there is included 4 feet of working space around the structure, the space occupied will increase to 11×11 feet or 121 square feet. By contrast, a conventional MDF structure requires a space roughly 150 feet long by 18 feet wide which corresponds to 2700 square feet versus 121 square feet.

Such a structure can be installed in a manhole in the vertical position in such a manner as to leave room for growth to the rear or front. To provide for growth, a growth unit would be supplied as a unit completely assembled with conductors and dielectric insulation with one of the new type adhesives and mounted on a jig. First using the jig to support the equipment, the unit will be moved into position to be attached to the rear or front of the existing structure and, while supported by the jig, pressed into engagement therewith and held until the adhesive dries. When the adhesive is dry, the bolts are removed from the original structure and replaced with longer bolts.

The growth procedure described above can be used either on the rear or front of the structure and no splicing is required. To connect the new unit to the new cable, it is only necessary to use a wire wrap tool since the unit will be delivered with standard connecting studs on all four sides.

The studs may be used to attach branch cables to the feeder cable such as described. To make the connection, the pairs from the feeder cable are connected to the left side of the structure and the pairs of wires from the branch cables are connected to the right side of the structure.

The wires of the feeder cable which go beyond the branch cables are still available to customers beyond this point and the cable installers will plug the wiper carriers into the structure beyond this point to indicate to another installer that no more wiper carriers can be used on the pairs already in use. Assuming that all of the pairs are in use in houses along a given street, if a house is vacated, all the installer has to do is remove the appropriate wiper carriers at the feeder cable terminal which instantly makes these wires available at other locations along the street all the way from the end of the cable to the central office. He then removes the wiper carriers at the appropriate terminals and inserts plugs indicating the vacancy and that it is ready for reuse. This capability can save labor to the extent of 40 to 50 percent. No splicing is required.

In any fairly large business building, there are many problems relating to the location of offices, desks, individual telephones and so forth. This is true even if the underfloor conduit was correctly designed initially.

Groups of people grow in number, plans change, other companies move in with different ideas, hence, telephones, computers and TWX gear location problems are constantly changing. Full flexibility to take care of such changes can be obtained by the use of the structure herein shown since it can be placed in the underfloor duct system and is comparatively small in size.

It should be understood that the present disclosure is for the purpose of illustration only and includes all modifications or improvements which fall within the scope of the appended claims.

I claim:

1. A multi-terminal connector structure comprised of nonconductive material containing spaced parallel lines of spaced parallel passages open at one end, two at least arrays of spaced parallel conductors situated in planes perpendicular to the axes of the passages in axially spaced parallel relation, with the conductors in adjacent arrays at right angles to each other, with the ends of the conductors extending from all four sides of the structure for attachment of conductor wires thereto, if required due to individual design requirements, and with portions of the conductors in each array extending into said passages, nonconductive wiper carriers adapted to be inserted into said passages through the open ends and rotated therein, conductive wiper elements extending radially from said carriers at an axial spacing corresponding to the axial distance between adjacent arrays of conductors adapted to be simultaneously engaged with said portions of the conductors extending into said passages and conductor means within the carriers connecting the wiper elements in each carrier to each other.

2. A structure according to claim 1 wherein the portions of the conductors extending into the passages from the adjacent arrays of conductors are axially aligned along said passages.

3. A structure according to claim 1 wherein there are at opposite ends of the passages means defining bearing openings for rotatably supporting the carriers for rotation within the passages to, in turn, rotate the wiper elements in planes parallel to the arrays of conductors and wherein the portions of the conductors extending into the passages extend into the paths of rotation of the wiper elements.

4. A structure according to claim 3 wherein the means defining the bearing openings at the open ends of the passages contain radial slots for admitting the wiper elements into said passages.

5. A structure according to claim 1 wherein the passages are of larger cross section than the carriers so that there are continuous spaces axially of the passages for accommodation of the radially extending wiper elements thereon.

6. A structure according to claim 1 wherein said carriers are removably mounted within said passages to enable adding to or removing wiper elements from the carriers.

7. A structure according to claim 1 wherein the conductors in each array comprise axially spaced back to back conductor elements such that by inserting a carrier into each of two passages along a single horizontal with the wiper elements on one corresponding to the distance between corresponding conductors of the one pair of axially spaced wipers in adjacent arrays and the wiper elements on the other corresponding to the distances between the corresponding conductors of the other pair of axially spaced wipers on the adjacent array, both the positive and negative sides of a circuit may be established.

8. A multi-terminal connector structure comprising a stack of grid plates containing spaced parallel lines of spaced openings which collectively define spaced parallel passages perpendicular to the planes of the grid plates, said passages being open at one end, said grid plates comprising alternately arranged conductor plates and spacer plates, spaced parallel conductor elements on one face of the conductor plates, said conductor elements being arranged at right angles to each other on adjacent conductor plates along the lines of openings therein with portions thereof projecting into the openings and with end portions projecting from the ends of the stack, nonconductive carriers adapted to be inserted into said passages, conductive wiping elements extending radially from the carriers at axially spaced distances corresponding to the axial distance between the portions of the conductive extending into said passages, said carriers being rotatable to move the wipers into engagement with said inwardly projecting conductor portions and conductive means within the carriers connecting the wiper elements in each carrier to each other.

9. A structure comprising a stack of grid plates containing spaced parallel lines of spaced openings which collectively define spaced parallel passages perpendicular to the planes of the grid plates, said passages being open at one end, said grid plates comprising alternately arranged conductor plates and spacer plates, spaced parallel conductor elements on the opposite faces of the conductor plates, said conductor elements on adjacent conductor plates being arranged at right angles to each other adjacent the lines of openings with portions thereof extending into the planes of the faces of the plates into said openings in axial spaced registration within the passages, nonconductive carriers adapted to be inserted into the passages through the open ends, conductive wiper elements extending radially from the carriers at axial spacing corresponding to the axial distance between the corresponding ones of the conductors on the conductor plates and conductor means within the carriers connecting the wiper elements to each other.

10. A structure according to claim 9 wherein there are end plates at the opposite ends of the stacks of grid plates containing openings, the openings in the grid plates intermediate the end plates being larger in cross section than the cross section of the carriers such as to provide clearance spaces within the passages for receiving the radially extending wiper elements and the openings in the end plates are of smaller cross section for rotatively supporting the carriers for rotation about axes parallel to the axes of the passages.

11. A structure according to claim 10 wherein the openings in the end plates define bearings for rotatably receiving the carriers and wherein the bearing openings at one end contain radial slots for admitting the radial wiper elements into the passages.

12. A structure according to claim 1 wherein each nonconductive carrier comprises a sleeve containing a wall slot longitudinally thereof and conductive material confined therein within which the proximal ends of the wiper elements are connected to the sleeve through the wall slot.

13. A structure according to claim 12 wherein the conductive material comprises slugs of metal confined in axial compression within the sleeve and the proximal ends of the wiper elements are affixed therein between adjacent ends of the slugs.

14. A structure according to claim 13 wherein there are a plurality of slugs of appropriate length such that a plurality of wiper elements may be provided longitudinally of the carrier.

15. A structure according to claim 8 comprising end plates at the opposite ends of the stack, one of which contains openings corresponding in number and disposition to the openings in the grid plates and the other of which contains no such openings, and means extending from one end plate to the other for securing the grid plates therebetween.

16. A structure according to claim 15 wherein the capacity of the structure may be increased by adding grid plates to the stack of plates included between the end plates.

17. A structure according to claim 8 wherein the capacity of the structure may be increased by increasing the horizontal and vertical dimensions of the grid plates to thereby increase the number of openings per grid plate.

18. A structure according to claim 15 wherein the vertical dimensions of the end plates are longer than the vertical dimensions of the grid plates so that the end plates provide supports for supporting the grid plates above the floor.

19. The method of making multi-terminal junctions comprising providing nonconductor grid plates containing spaced parallel lines of openings, providing conductor grids comprised of nonconductive material containing openings corresponding in number and disposition to the openings in the nonconductive grids wherein said latter openings have along one side inwardly extending shoulders and spaced parallel conductors on the faces along the openings which extend continuously from edge to edge and which cover the shoulders, assembling the conductor plates and nonconductor plates alternately with adjacent conductor plates so oriented that the conductors are at right angles, the openings in all of the grids are aligned and the shoulders are all at one side, and binding the grid plates in a stack between end plates containing bearing openings corresponding in number and disposition to the openings in the grid plates, the openings in one of the end plates containing radial slots and providing carrier elements for plugging into the passages and for rotation therein with wiper elements extending radially therefrom and at an axial spacing corresponding to the axial distance between conductors.

20. A structure comprising a stack of alternately arranged conductor plates and spacer plates, said plates containing spaced parallel lines of spaced openings which collectively define spaced parallel passages perpendicular to the planes of the plates, said openings in the conductor plates being of different shape than the openings in the spacer plates such that portions of the conductor plates extend into the passages in axially spaced parallel relation along one side of the passages, spaced parallel conductive elements on the conductor plates, said conductor elements extending continuously along the lines of openings therein, covering the inwardly extending portions of the conductor plates and on alternate conductor plates, being oriented at right angles to each other, nonconductive wiper carrier elements adapted to be inserted into said passages through the opened ends and rotated therein, conductive wiping elements extending radially from said nonconductive wiper carriers at an axial spacing corresponding to the axial distance between adjacent conductor elements adapted to be simultaneously engaged with said portions of the conductor elements extending into said passages and conductive means within the carrier elements connecting the wiper elements in each carrier element to each other.

21. A structure according to claim 8 wherein there are axially spaced parallel protrusions along one side of the passages which support the portions of the conductors extending into said passages.

22. A structure according to claim 8 wherein the portions of the conductors extending into the passages are supported by portions of the grid plates extending into said passages.

23. A structure comprising a stack of alternately arranged conductor plates and spacer plates, said plates containing spaced parallel lines of spaced openings which collectively define spaced parallel passages perpendicular to the planes of the plates, said openings in the conductor plates containing at one side inwardly extending shoulders situated along one side of the passage in axially spaced relation, spaced parallel conductor elements on the conductor plates, said conductor elements extending continuously along the lines of openings therein, covering the shoulders and on alternate plates being oriented at right angles to each other, nonconductive wiper carriers adapted to be inserted into said passages through the open ends and rotated therein, conductive wiper elements extending radially from said wiper carriers at an axial spacing corresponding to the axial spacing between adjacent conductors adapted to be simultaneously engaged with said portions of the conductors extending into said passages and conductor means within the wiper carrier connecting the wiper elements in each wiper carrier to each other.

* * * * *